US008336861B2

(12) United States Patent
Chou

(10) Patent No.: US 8,336,861 B2
(45) Date of Patent: Dec. 25, 2012

(54) CLUTCHABLE WINCH

(76) Inventor: Yeh-Chien Chou, Taoyuan Hsien (TW)

( * ) Notice: Subject to any disclaimer, the term of this patent is extended or adjusted under 35 U.S.C. 154(b) by 342 days.

(21) Appl. No.: 12/780,083

(22) Filed: May 14, 2010

(65) Prior Publication Data

US 2011/0278519 A1 Nov. 17, 2011

(51) Int. Cl.
*B66D 1/14* (2006.01)

(52) U.S. Cl. ..... 254/365; 254/222; 254/223

(58) Field of Classification Search ..... 254/222, 254/223, 243, 365, 368, 370
See application file for complete search history.

(56) References Cited

U.S. PATENT DOCUMENTS 5,002,259 A * 3/1991 Manning et al. ..... 254/350
7,413,170 B2 * 8/2008 Ruan ..... 254/244
7,472,890 B2 * 1/2009 Huang ..... 254/223
2002/0195594 A1 * 12/2002 Cauchon ..... 254/243
2007/0114504 A1 * 5/2007 Ruan ..... 254/223

* cited by examiner

*Primary Examiner* — Emmanuel M Marcelo

(57) ABSTRACT

A clutchable winch contains a shaft member including: a tube used to fix a belt; a fitting piece including a central hole mounted thereon; a column fixed on the central hole; a sleeve coupled with the fitting piece, including a groove arranged on one end thereof and a connecting end secured on another end thereof, the connecting end including plural apertures disposed thereon; a positioning disc fixed on a bottom end of the groove, including plural first inclined teeth arranged therearound, the first inclined teeth being spaced apart evenly from each other and each having a vertical side; an annular actuating plate fitted on the column, including a hexagonal pore arranged on a central portion thereof and plural second inclined teeth disposed on one end surface thereof, wherein each second tooth includes a vertical fringe; a compression spring defined between the actuating plate and the fitting piece of the tube.

8 Claims, 6 Drawing Sheets

CLUTCHABLE WINCH

BACKGROUND OF THE INVENTION

1. Field of the Invention

The present invention relates to a winch, and more particularly to a clutchable winch.

2. Description of the Prior Art

Referring to FIGS. 1 and 2, a conventional clutchable winch is used to band and fix merchandise in transporting vehicles during transporting process, and contains a U-shaped support 1, a shaft member 2, a ratchet 3, a paw 4, and a rotary stem 5, wherein the shaft member 2 includes a slot 2*a* disposed thereon to inert a belt, and the shaft member 2 includes a head portion 2*b* mounted on one end thereof, the head portion 2*b* includes four or two holes 2*c* to insert a bar so as to actuate the shaft member 2 to rotate, thus banding the merchandise tightly.

In operation, one end of the belt is fixed to another side of the vehicle, and another end of the belt is inserted through the slot 2*a*, the bar is inserted to the hole 2*c* to rotate so that the belt is actuated to rotate by the shaft member 2, and then the ratchet 3 and the paw 4 are used to retain the shaft member 2, thereby banding the merchandise securely.

However, the head portion 2*b* is integrally welded with the shaft member 2, accordingly when the bar is rotated toward a predetermined angle, it interferes with a carrier of the vehicle, hence the bar has to be removed and then inserted to another hole 2*c* to rotate the belt once more repeatedly, causing time and force consumption.

The present invention has arisen to mitigate and/or obviate the afore-described disadvantages.

SUMMARY OF THE INVENTION

The primary object of the present invention is to provide a clutchable winch that when a bar is pressed downward completely, it is further pulled upward directly without being removed in advantage so as to return an original position to roll the belt, obtaining an continuous operation to save operating time and force.

To obtain the above objectives, a clutchable winch provided by the present invention contains a shaft member used to pull and roll a belt tightly and including:

a tube used to fix one end of the belt;

a fitting piece formed in a circle shape, including a central hole mounted thereon to be connected with one end of the tube;

a column fixed on the central hole of the fitting piece;

a sleeve coupled with the fitting piece, including a groove arranged on one end thereof, and including a connecting end secured on another end thereof, the connecting end including a plurality of apertures disposed thereon;

a positioning disc fixed on a bottom end of the groove of the sleeve, including a number of first inclined teeth arranged around an outer wall thereof, and the first inclined teeth being spaced apart evenly from each other and each having a vertical side;

an annular actuating plate fitted on the column, including a hexagonal pore arranged on a central portion thereof to correspond to the column, including a plurality of second inclined teeth disposed on one end surface thereof to correspond to the first inclined teeth, wherein each second tooth includes a vertical fringe;

a compression spring defined between the actuating plate and the fitting piece of the tube.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
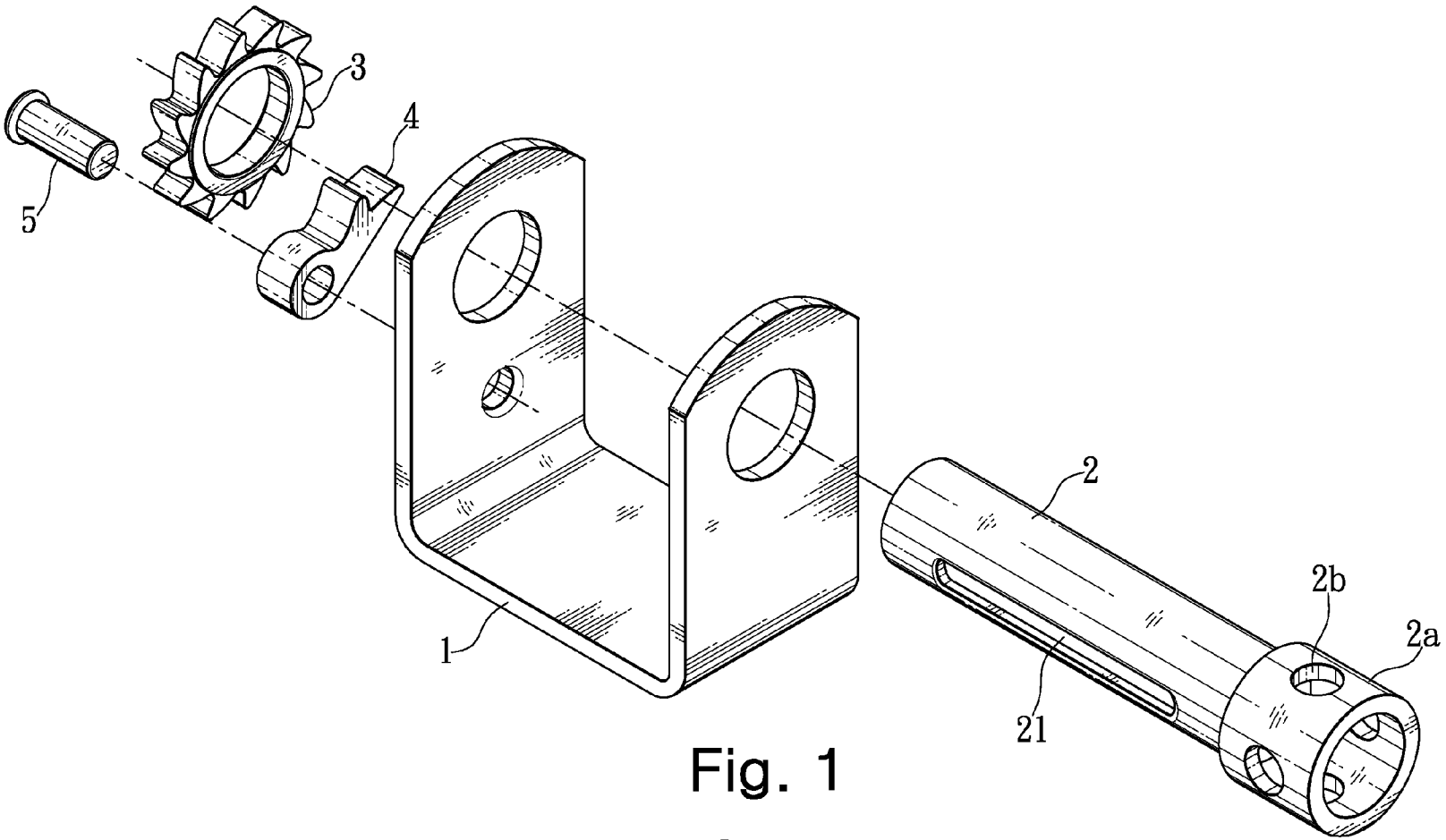
Fig. 1 PRIOR ART
FIG. 1 is a perspective view showing the exploded components of a conventional clutchable winch.
Figure 2:
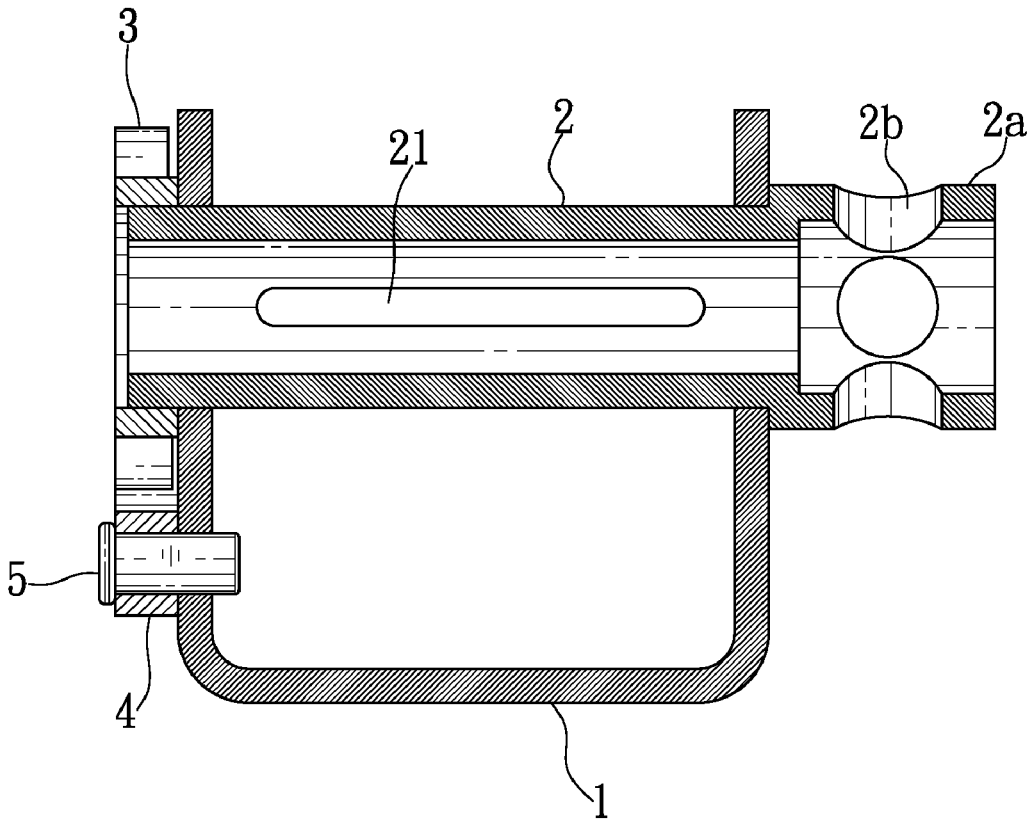
Fig. 2 PRIOR ART
FIG. 2 is a cross sectional view showing the assembly of the conventional clutchable winch.
Figure 3:
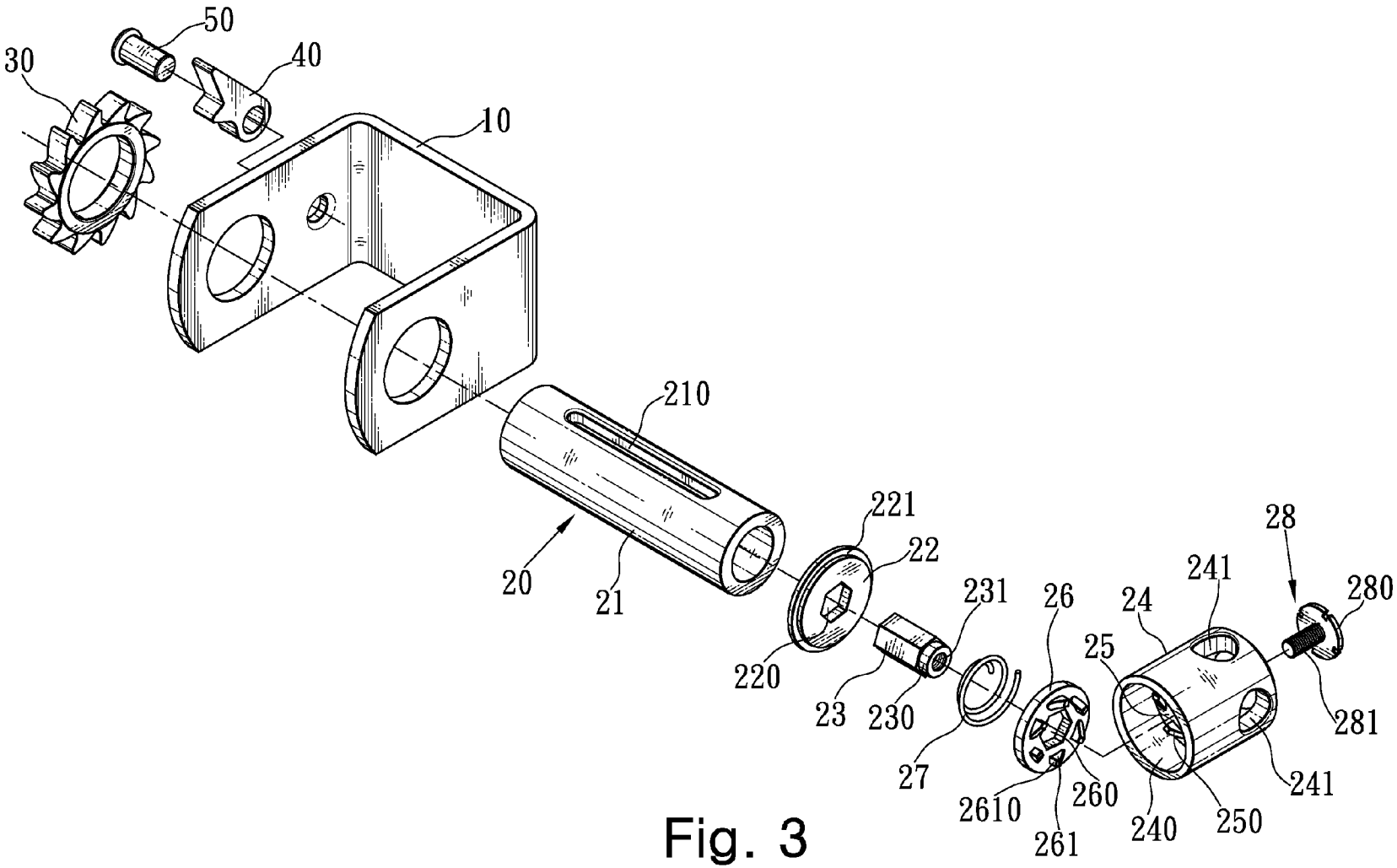
FIG. 3 is a perspective view showing the exploded components of a clutchable winch according to a preferred embodiment of the present invention.
Figure 4:
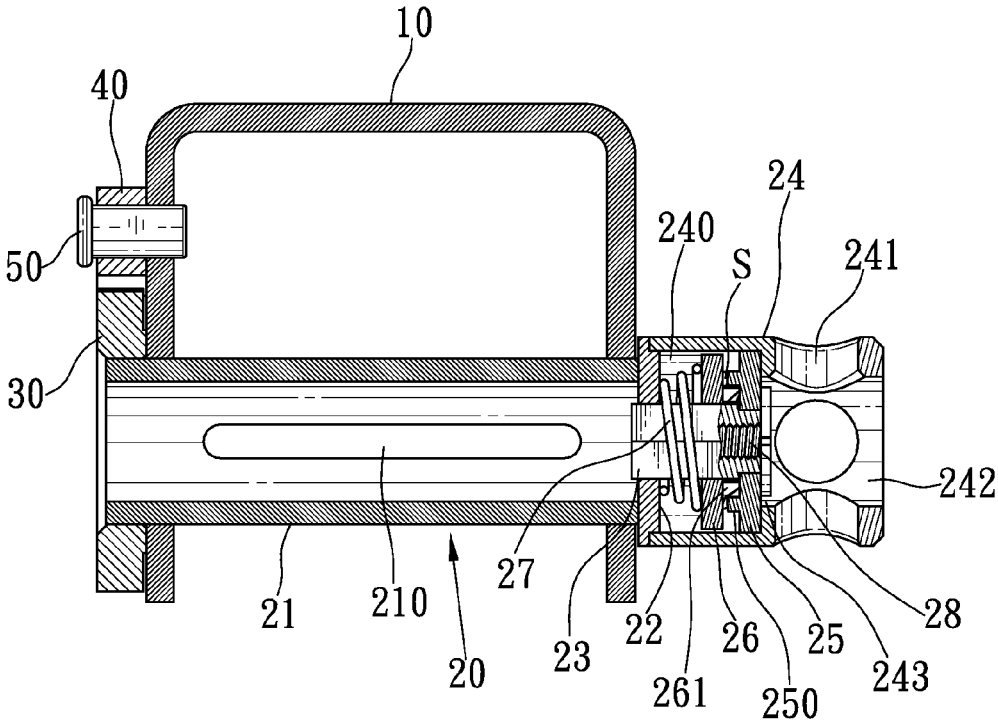
FIG. 4 is a cross sectional view showing the assembly of the clutchable winch according to the preferred embodiment of the present invention.

Referring to FIGS. 3 and 4, a clutchable winch in accordance with the present invention comprises a U-shaped support member 10, a shaft member 20, a ratchet 30, a paw 40, and an axial stem 50, wherein the support 10, the ratchet 30, the paw 40, and the axial stem 50 are well known, accordingly further remarks will be omitted.

Figure 5:
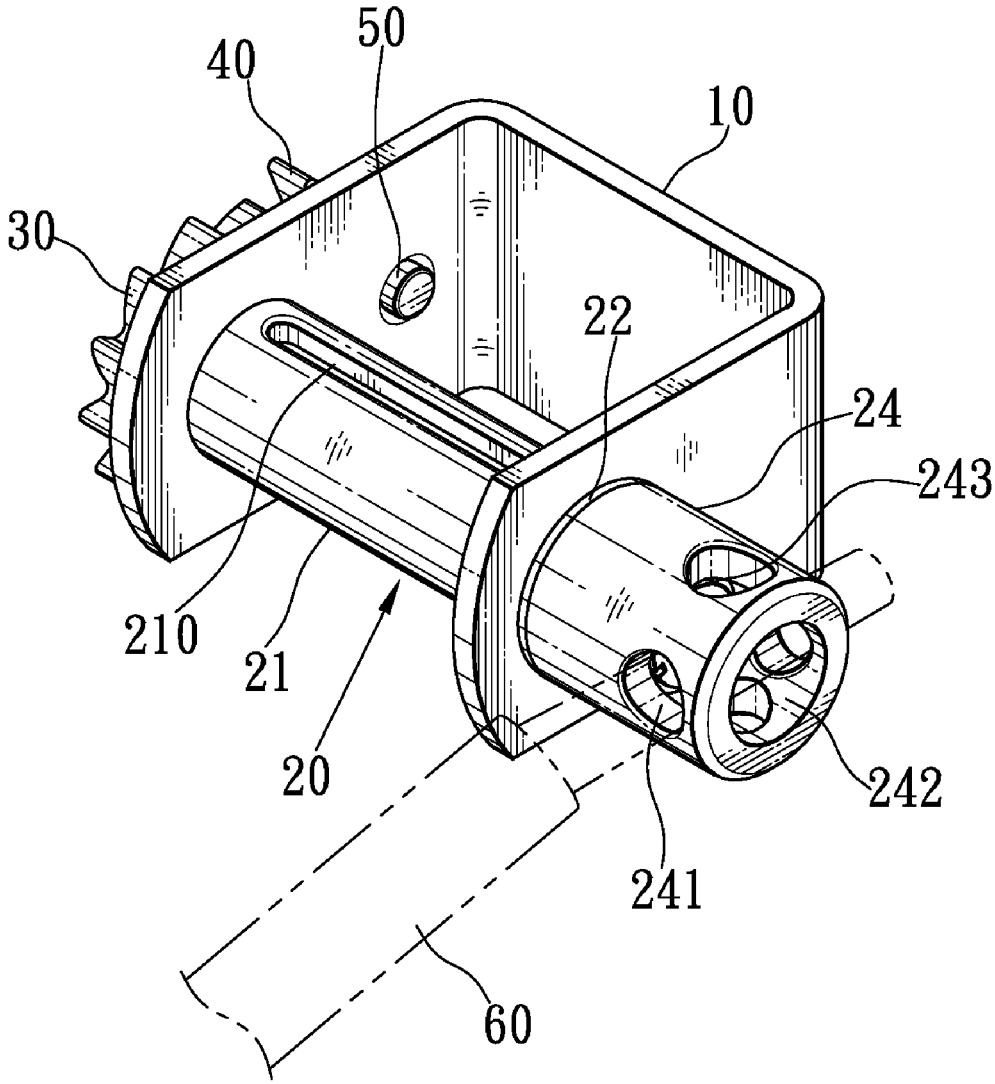
FIG. 5 is a perspective view showing the assembly of the clutchable winch according to the preferred embodiment of the present invention.
Figure 6:
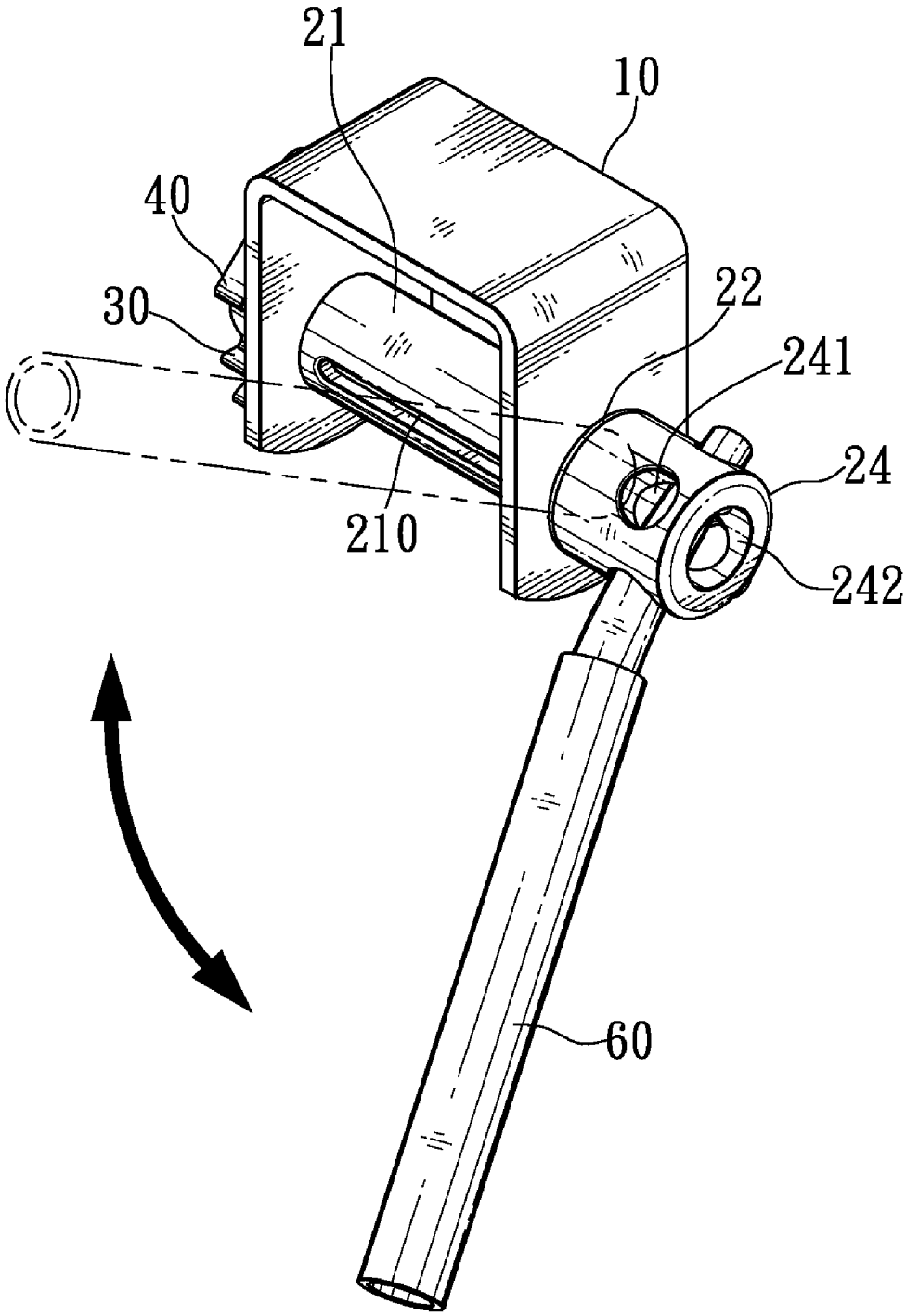
FIG. 6 is a perspective view showing the operation of the clutchable winch according to the preferred embodiment of the present invention.

As shown in FIGS. 3 and 5, the shaft member 20 comprises:

a tube 21 formed in a hollowly circular pipe shape, and including a slot 210 disposed on an peripheral side thereof to insert a belt (not shown);

a fitting piece 22 formed in a circle shape, including a central hole 220 mounted thereon to be connected with one end of the tube 21 and formed in a hexagon shape, and including a stepped rim 221 fixed around an outer rim thereof;

a column 23 fixed on the central hole 220 of the fitting piece 22 and formed in a hexagon shape, including an inserting end 230 extending outward from one end thereof, and including a bore 231 formed on a central portion thereof;

a sleeve 24 coupled with the fitting piece 22, including a groove 240 arranged on one end thereof to receive the stepped rim 221 of the fitting piece 22, including a connecting end secured on another end thereof, the connecting end including a plurality of apertures 241 disposed thereon, and the groove 240 including an opening 243 mounted on a bottom end thereof to communicate with the connecting end;

a positioning disc 25 fixed on the bottom end of the groove 240 of the sleeve 24, including a number of first inclined teeth 250 arranged around an outer wall thereof, and including an orifice 251 formed on a central portion thereof relative to the inserting end 230 of the column 23, wherein the first inclined teeth 250 are spaced apart evenly from each other and each has a vertical side;

an annular actuating plate 26 fitted on the column 23, including a hexagonal pore 260 arranged on a central portion thereof to correspond to the column 23, including a plurality of second inclined teeth 261 disposed on one end surface thereof to correspond to the first inclined teeth 250, wherein each second tooth 261 includes a vertical fringe 2610;

a compression spring 27 defined between the actuating plate 26 and the fitting piece 22 of the tube 21;

a bolt element 28, inserted into the connecting end of the sleeve 24 and screwed with the bore 231 of the column 23, including a head tab 280 and an screwing insertion 281 extending outward from the head tab 280 so that after the bolt element 28 screws with the column 23, the head tab 280 is engaged with the positioning disc 25 to lock the sleeve 24 with the fitting piece 22.

In operation, as illustrated in FIG. 5, a bar 60 is inserted into any two opposite apertures 241 of the sleeve 24, and because the sleeve 24 and the tube 21 are engaged with each other by using the first inclined teeth 250 of the positioning disc 25 and the second inclined teeth 261 of the actuating plate 26 respectively, the actuating plate 26 is pushed by the compression spring 27, the actuating plate 26 and the column are hexagonal, and the column 23 is connected with the fitting piece 22 and the tube 21, when the sleeve 24 is rotated, the positioning disc 25 and the actuating plate 26 actuate the column 23 so that the sleeve 24 and the tube 21 act with each other.

Furthermore, the first and the second inclined teeth 250, 261 are provided with respective tilted angles S to abut the first and the second inclined teeth 250, 261 against each other, such that that when they contact with each other to rotate toward a certain direction opposite to the vertical fringe 2610, the first and the second inclined teeth 250, 261 are actuated by each other. While as the first and the second inclined teeth 250, 261 contact with each other and move toward another direction opposite to the respective tilted fringes thereof, they push each other to move, so that the actuating plate 26 is pressed inward to cause an intermitting movement, thus having an idle rotation between the sleeve 24 and the tube 21.

Therefore, when the bar 60 is pressed downward completely, it is further pulled upward directly without being removed in advantage so as to return an original position to roll the belt, obtaining an continuous operation to save operating time and force.

While we have shown and described various embodiments in accordance with the present invention, it is clear to those skilled in the art that further embodiments may be made without departing from the scope of the present invention.

What is claimed is:

1. A clutchable winch comprising a shaft member used to pull and roll a belt tightly and including:

a tube used to fix one end of the belt;

a fitting piece formed in a circle shape, and including a central hole mounted thereon to be connected with one end of the tube;

a column fixed on the central hole of the fitting piece;

a sleeve coupled with the fitting piece, including a groove arranged on one end thereof, and including a connecting end secured on another end thereof, the connecting end including a plurality of apertures defined thereon;

a positioning disc fixed on a bottom end of the groove of the sleeve, and including a number of first inclined teeth arranged around an outer wall thereof, and the first inclined teeth being spaced apart evenly from each other and each having a vertical side;

an annular actuating plate fitted on the column, including a hexagonal pore arranged on a central portion thereof to correspond to the column, including a plurality of second inclined teeth disposed on one end surface thereof to correspond to the first inclined teeth, wherein each second tooth includes a vertical fringe;

a compression spring defined between the actuating plate and the fitting piece of the tube.

2. The clutchable winch as claimed in claim 1, wherein the tube is formed in a hollowly circular pipe shape and includes a slot defined on a peripheral side thereof to insert the belt.

3. The clutchable winch as claimed in claim 1, wherein the central hole of the fitting piece is formed in a hexagon shape, and the fitting piece includes a stepped rim fixed around an outer rim thereof.

4. The clutchable winch as claimed in claim 1, wherein the column is formed in a hexagon shape, includes an inserting end extending outward from one end thereof, and includes a bore formed on a central portion thereof.

5. The clutchable winch as claimed in claim 4, wherein the positioning disc includes an orifice formed on a central portion thereof relative to the inserting end of the column.

6. The clutchable winch as claimed in claim 1, wherein the groove of the sleeve includes an opening defined therein to communicate with the connecting end of the sleeve.

7. The clutchable winch as claimed in claim 1, wherein the annular actuating plate includes a hexagonal pore arranged on a central portion thereof to correspond to the column.

8. The clutchable winch as claimed in claim 1, wherein the first and the second inclined teeth are provided with respective tilted angles to abut the first and the second inclined teeth against each other.

* * * * *